United States Patent [19]

Speice

[11] 4,379,588

[45] Apr. 12, 1983

[54] REVOLVING SOLAR LOUNGER

[76] Inventor: Donald G. Speice, 14 Barberry La., Westerly, R.I. 02891

[21] Appl. No.: 203,548

[22] Filed: Nov. 3, 1980

[51] Int. Cl.[3] ..... A47C 31/00

[52] U.S. Cl. ..... 297/217; 297/349; 297/330; 297/331; 128/372

[58] Field of Search ..... 297/217, 330, 349; 128/372, 376; 180/65 B; 108/20

[56] References Cited

U.S. PATENT DOCUMENTS

| | | | |
|---|---|---|---|
| 330,231 | 11/1885 | Hall et al. | 297/332 |
| 2,667,169 | 1/1954 | Kambourakis | 128/372 |
| 3,024,067 | 3/1962 | Brandoli | 297/355 |
| 3,591,234 | 7/1971 | Condon | 297/217 |
| 3,655,239 | 4/1972 | Agosti | 297/331 |
| 3,908,666 | 9/1975 | Osborne | 128/372 |
| 3,943,726 | 3/1976 | Miller | 180/65 B |
| 4,140,128 | 2/1979 | Van Der Schaaf | 108/20 |

*Primary Examiner*—Francis K. Zugel
*Attorney, Agent, or Firm*—Salter & Michaelson

[57] ABSTRACT

A solar lounger is disclosed which rotates in response to energization from the sun's rays. The solar lounger has a chaise type chair which is rotatably supported on a base. Photovoltaic solar cells are mounted on said chair and generate electrical energy in response to the sun's rays. Said electrical energy is used to power a drive motor which causes said chair to rotate relative to said base.

7 Claims, 6 Drawing Figures

REVOLVING SOLAR LOUNGER

BACKGROUND OF THE INVENTION

The present invention relates generally to loungers of the type used for suntanning and particularly to a lounger having a rotatable platform.

For years people have considered sunbathing a relaxing and enjoyable pastime. The development of a deep even tan has always been considered to give one a healthy, outdoor appearance. Suntanning in moderation can have a beneficial effect on the skin but over-exposure and localized burning should always be avoided. One factor that governs the evenness of a tin is the relationship of the sunbather to the direction of the sun's rays. In non-tropical climates where the sun is not directly overhead, the rays will be angularly directed towards a particular side or portion of the sunbather's body. Obviously, the portion of the bather's body which is normal to the sun's rays will always be the portion which is most effected thereby. The present invention relates to an apparatus whereby the relationship of the user to the sun's rays is constantly varied so that the user will obtain an even natural tan.

Prior to this invention numerous devices have been tried for assisting sunbathers to achieve natural even tans. Devices have been tried which reflect the sun's rays onto various portions of a sunbather's body with mirrors to give the sunbather an all around tan. Devices have also been tried which maintain the user's body at an angle which is normal to the sun's rays. In addition, suntanning tables have been tried which rotate on a continuing basis to give the user 360° exposure to the sun. U.S. Pat. Nos. 3,461,878; 3,908,666 and 4,140,128 disclose devices of these types. None of these devices, however, is completely effective in assuring a sunbather a uniform even exposure to the sun, particularly on intermittently sunny and overcast days.

It has therefore been found desirable to provide a lounger which rotates in response to the sun's rays, and which therefore represents a substantial improvement over the prior art. The solar lounger herein disclosed rotates only in response to the sun's rays to provide the user with uniform even exposure. Since the lounger rotates only when the sun is out, the user is assured of receiving uniform exposure to the sun on intermittently sunny and cloudy days.

SUMMARY OF THE INVENTION

The present invention relates to a solar lounger which is rotated in response to the sun's rays. The lounger consists of a chaise type chair which is mounted on a fixed base. The base has an electric motor therein which is capable of rotating the chaise type chair relative to the base. The lounger also has photovoltaic solar cells which generate electrical current in response to direct exposure to the sun's rays. The electrical current so generated powers the electric motor in the base which in turn rotates the chaise type chair; thus, the chair turns only when the sun is out. On a day when the sun is intermittently overcast with clouds, the chair turns intermittently. Therefore, the user receives uniform exposure to the sun at all angles which aids in the development of an even natural tan without localized burning.

It is therefore a primary object of this invention to provide a solar lounger which rotates in response to the sun's rays, and hence allows the user to obtain an even, natural suntan.

Another object of this invention is to provide a solar lounger which will allow the user to receive uniform exposure to the sun's rays without having to constantly change positions.

A further object is to provide a solar lounger which may be stored in a substantially upright, collapsed position.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
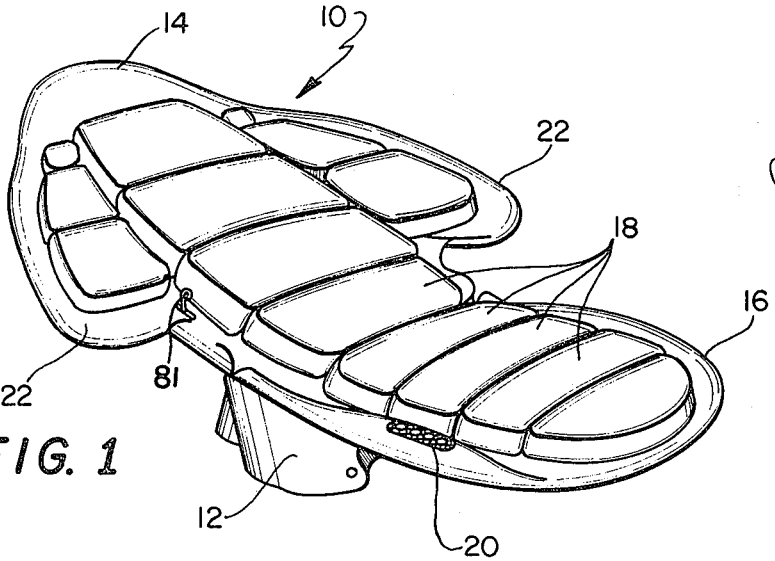
FIG. 1 is a perspective view of the solar lounger of the instant invention in operative position ready for use.
Figure 2:
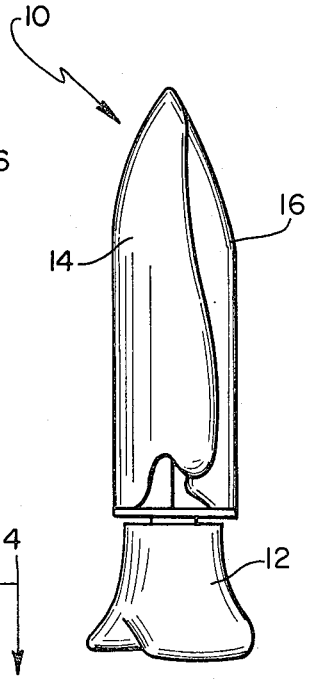
FIG. 2 is an elevational view showing the solar lounger in the upright, collapsed position for storage.

Referring to the drawings, FIGS. 1 and 2, respectively, show the fully opened position and the upright collapsed position of the lounger. The lounger as shown generally at 10 in FIG. 1 has a base 12, a back portion 14 and a bottom portion 16. The back portion and the bottom portion are pivotally attached to and are supported by the base 12 and cooperate to form a chaise type chair. Further as shown in FIG. 1, the back portion 14 has arm portions 22 extending outwardly from the sides thereof, the perimeters of said arm portions being generally arcuate. The upper end of the back portion is also defined by a curved line which follows the general curvature of the outwardly extending arm portions. The outer end of the lower portion 16 has a similar curved configuration. A plurality of cushions 18 are provided to support the body and arms of the user, as shown in FIG. 1. Photovoltaic solar cells 20 are mounted on lower portion 16 of the lounger, it being understood that said cells are in substantially horizontal disposition, so that when the chair is in use, the cells face upwardly and thereby receive maximum exposure to the sun's rays.

Figure 3:
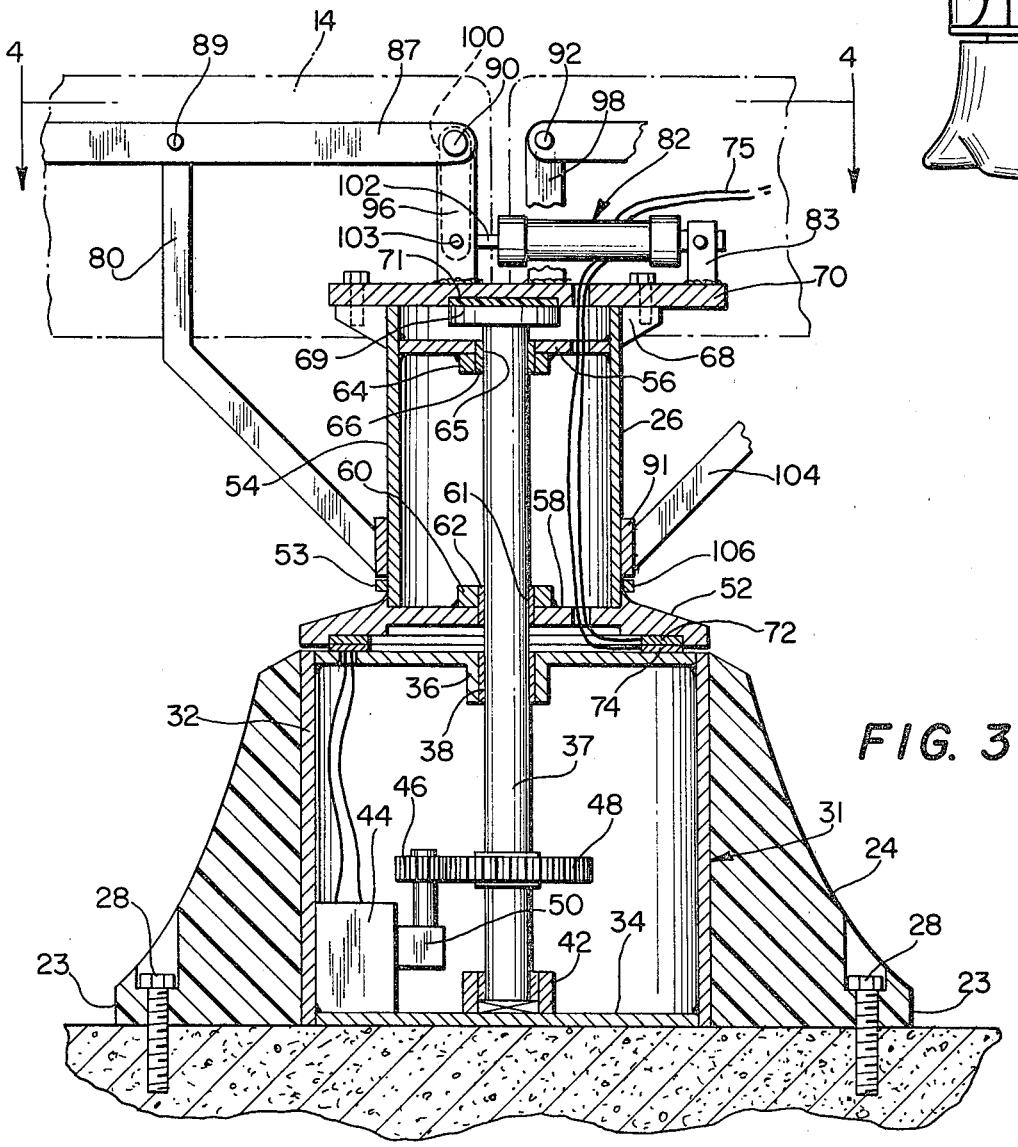
FIG. 3 is an enlarged fragmentary sectional view of the base including the pivoting mechanism of the lounger.

A sectional view of the base section of the lounger is shown in FIG. 3. The base 12 generally has a lower outer housing 24 and an upper outer housing 26. The lower outer housing is securely attached to the mounting surface by any suitable means, such as bolts or mounting screws 28 as shown. The outer perimeter of the lower outer housing has a bottom lip 23 and is then defined generally by a curved surface which extends inwardly and upwardly from said bottom lip. The inner configuration of the lower outer housing is generally cylindrical and is adapted to receive therein a lower inner housing 31 comprising side wall 32, upper wall 30 and bottom wall 34, said lower inner housing being substantially cylindrical and hollow. A hub 36 extends downwardly from upper wall 30 of lower inner housing 31 defining a cylindrical bore 37 in the center of upper wall 30, said bore having a bearing sleeve 38 adapted to receive shaft 40. Thrust bearing 42 is located in the center of bottom wall 38 and is adapted to receive the lower end of shaft 40 said shaft extending perpendicularly upward from said bottom wall 34. Bore 37 with bearing sleeve 38 and thrust bearing 42 cooperate to rotatingly mount shaft 40. A drive motor 44 is also located within lower inner housing 31 and is operative to slowly rotate shaft 40 by means of gear reduction box 50 and drive gears 46 and 48.

The upper outer housing 26 as shown in FIG. 3 has a substantially hollow cylindrical configuration, and comprises side wall 54, upper wall 56 and bottom wall 58 with lower flange or skirt 52 protruding outwardly from the lower end of said side wall. Flange 60 and bearing sleeve 62 are securely attached to bottom wall 58 and define a cylindrical bore 61 in the center thereof for receiving shaft 40. Flange 64 and collar 66 are securely attached to upper wall 56 and define a similar cylindrical bore in the center thereof for receiving shaft 40. Side wall 54 of the housing 26 extends upwardly beyond upper wall 56 and has an external ring member 68 connected thereto for receiving horizontal support plate 70 thereon. Shaft 40 extends through bores 61 and 65 in the housing 26 and has a circular clutch disc 69 secured thereto at its upper extremity. Clutch disc 69 is received in and frictionally contacts recessed area 71 on the bottom side of support plate 70, said clutch disc thereby supporting said support plate. The horizontal support plate 70 and the housing 26 are also thereby supported by shaft 40 which in turn is rotatably supported at its lower end by thrust bearing 42. Accordingly, energization of motor 44 causes shaft 40 to rotate thereby causing support platform connector housing 26 and horizontal support plate 70 to also rotate. Further, since clutch disc 69 makes only frictional contact with recessed area 71, any interference with the rotation of support plate 70 will cause slippage between said recessed area and said dics to prevent damage to motor 44.

It will be further noted from FIG. 3 that a contact ring 72 is located on the bottom surface of the lower flange or skirt 52 of the housing 26. A contact ring 74 is correspondingly located on the top surface of the upper wall 30 of the lower inner housing. Both contact rings 72 and 74 are effectively insulated from their respective mountings so that they may be used to conduct electrical current. Contact rings 72 and 74 are positioned so that they are always in contact with each other to provide electrical continuity while housing 26 is rotating relative to housing 31. Wiring 73 interconnects contact ring 74 to motor 44, while wiring 75 extends from contact ring 72, upwardly through housing 26, through horizontal support plate 70 and then to the photovoltaic solar cells 20 located on the lower portion of the chair. Thus current generated by solar cells 20 is transmitted to motor 44 to rotate shaft 40, which in turn, via friction clutch 69, causes corresponding rotation of housing 26 and plate 70.

Figure 4:
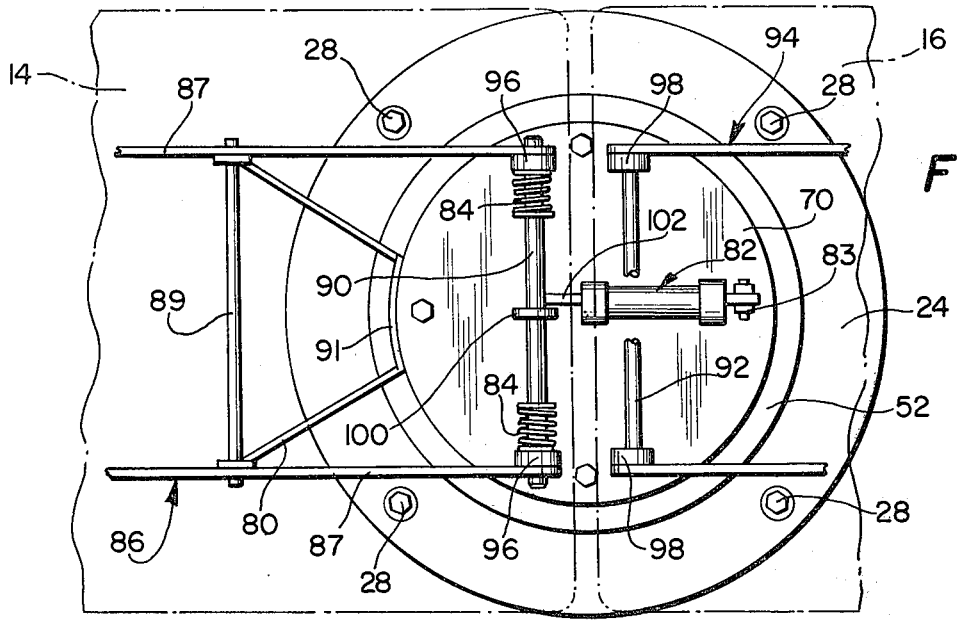
FIG. 4 is a section taken on line 4—4 of FIG. 3.

Both lower portion 16 and back portion 14 of the chair are pivotally attached to and supported by horizontal support plate 70. They may therefore be swung upwardly to substantially vertical positions to effect a collapsed form of the chair for storage as illustrated in FIG. 2. The pivoting mechanism for both the lower portion and back portion of the chair is shown in detail in FIGS. 3 through 6. As may be noted from FIG. 4, the back portion of the pivoting assembly includes two back portion vertical mounting brackets 96 which are secured to the horizontal support plate 70. Holes are provided at the upper ends of the mounting brackets 96 which receive and retain the back portion pivot shaft 90 allowing said shaft 90 to rotate freely in said holes. A pivot arm 100 is securely attached to the center of shaft 90 and extends vertically downward therefrom when the back portion of chair is in a horizontal position. The back portion support frame 86 is of conventional frame-type structure and comprises elongated members 87 which are attached to opposite ends of the back portion pivot shaft 90, said frame being attached to said shaft so that it is substantially perpendicular to the back portion pivot arm 100. Torsion spring 84 are also provided on shaft 90 as shown in FIG. 4 to normally bias ack portion 14 upwardly in the direction of the arrow shown in FIG. 4. The purpose of the torsion spring 84 is to facilitate the adjustment and positioning of the back portion of the chair and the springs are therefore sized accordingly. Back portion horizontal stop bracket 80 is also included as part of the pivoting mechanism of the chair. The bracket 80 is pivotally attached to the two elongated members 87 of the back portion support frame. The upper end of the bracket 80 is pivotally secured to members 87 as at 89 and the lower end of the bracket has a pad or foot 91 which contacts the outer surface of housing 26 and vertical stop 53 thereon. The stop bracket thereby limits the movement of the back portion of the chair preventing the downward movement thereof beyond the horizontal plane.

Figure 5:
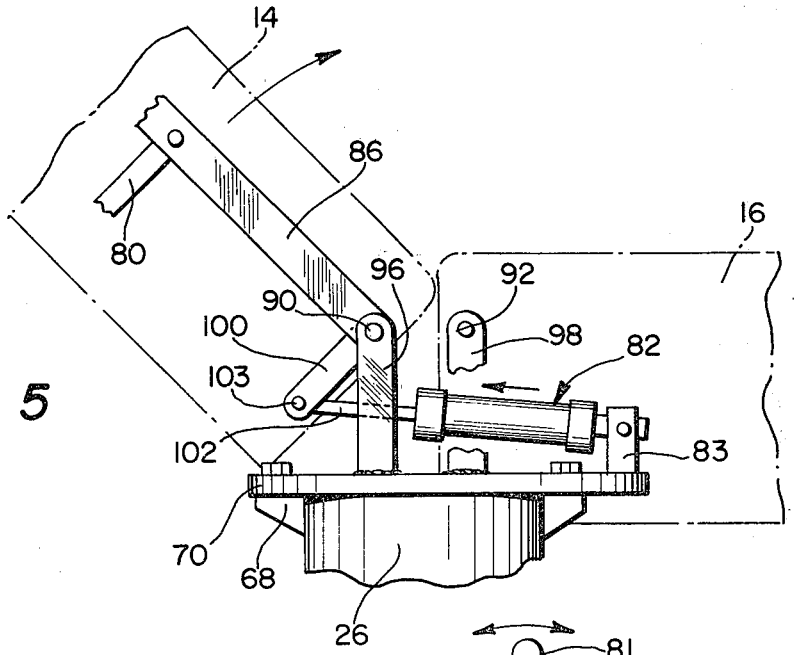
FIG. 5 is a fragmentary elevational view of the pivoting mechanism of the lounger.
Figure 6:
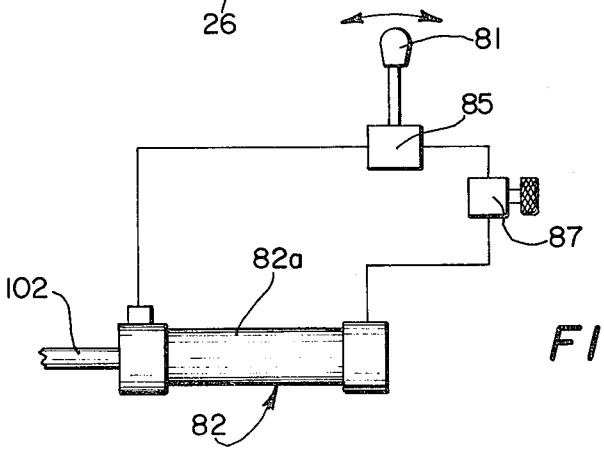
FIG. 6 is a schematic of the hydraulic system which forms a part of the lounger.

The hydraulic piston assembly is shown in FIGS. 3 through 5 of the drawings and the hydraulic system is shown schematically in FIG. 6 of the drawing. The piston assembly 82 consists of a piston housing **82*a* with a hydraulic piston located therein connected to piston rod 102. As may be noted from FIG. 6, a hydraulic circuit is provided which allows for the adjustment of the relative position of the hydraulic piston within the housing 82*a* by adjusting the location of the hydraulic fluid within the system by means of hydraulic adjustment valve 85 which is controlled by lever 81. The hydraulic piston assembly is used for controlling and retaining the relative angle of the back portion of the chair. As will be noted from FIG. 5, piston assembly 82 is pivotally attached to a piston mount 83, which is rigidly secured to plate 70. As may also be noted from FIG. 5, the piston rod is pivotally connected to the back portion pivot arm 100 as at 103. Therefore, the position of the piston within the piston housing determines the angular position of the back portion pivot arm 100. Since the back portion pivort arm is rigidly attached to the pivot shaft 90 which in turn is rigidly attached to the back portion support frame 86, it will be seen that movement of the back portion pivot arm will result in a corresponding movement of support frame 86. Hence, by fixing the position of the piston within the piston housing, the angle of the back portion of the chair is also fixed. The angle of the back portion of the chair may be adjusted downwardly by operating the lever 81 to open the hydraulic adjustment valve 85 and applying a manual downward force on the back portion 14 until the desired angular position is achieved at which time lever 81 is closed to hydraulically retain the back portion in its adjusted position. The angle of the back portion may be adjusted upwardly simply by pulling lever 81 to open the adjustment valve 85 to open the hydraulic circuit whereby torsion springs 84 are allowed to pivot the back portion upwardly until the desired angular position is achieved at which time the lever 81 is closed to hydraulically maintain the back in its adjusted position. Both the upward and the downward movement of the back portion are also dampened by the hydraulic system since movement of the back portion requires flow of hydraulic fluid within the system. This dampening effect may be adjusted with hydraulic dampening valve 87 shown in FIG. 6**.

The lower portion 16 of the chair also has a pivotal mechanism for altering the angle thereof. The pivoting mechanism for the lower portion of the chair is substantially similar to the mechanism for the back portion of the chair, as just described. However, it does not include torsion springs or a hydraulic piston assembly. As a result, the lower portion of the chair can only be fixed in either a horizontal or a vertical position, and cannot be maintained at other angles. The pivotal mechanism for the lower portion of the chair does, however, include lower portion support frame 94, lower portion vertical mounting bracket 98, lower portion pivot shaft 92, lower portion horizontal stop bracket 104 and vertical stop 106. These elements are substantially similar to the corresponding elements described for the back portion pivotal assembly and are similarly interconnected. When both the back and lower portions of the chair are pivoted to substantially vertical positions, they define a collapsed form of the chair thereby facilitating its storage and handling.

Both the back portions and the lower portions of the chaise type chair 14 and 16 respectively, are secured to their corresponding support frames 86 and 94 respectively to provide the completed chair generally shown at 10 of FIG. 1 having cushions and photovoltaic solar cells positioned thereon as previously described herein.

The completed chair as shown generally at 10 of FIG. 1 rotates in response to energization from the sun's rays. The solar cells as herein described develop electrical energy in response to sunlight. Said electrical energy is transmitted to an electric motor 44 which causes shaft 40 to rotate. This in turn causes the horizontal support plate 70 and the upper housing 26 to rotate with the chair rotating therewith. When the sun's rays are sufficiently strong, they will energize the solar cells causing the chair to rotate. The solar cells and the motor are designed so that with maximum energization of the solar cells, the chair will rotate at a rate of approximately one revolution per 15 minutes. During periods of intermittently overcast weather, the chair will rotate only while the sun is out and during periods of overcast, rotating of the chair will cease.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A solar lounger comprising:

(a) a base;

(b) means for supporting a person in a reclined disposition on said base;

(c) collecting means disposed in a substantially unobstructed upwardly facing location on said lounger receiving and collecting solar energy and continuously converting same to electrical energy; and (d) electrical motor means mounted in said lounger and powered by said electrical energy continuously rotating said support means relative to said base during periods when solar energy reaches said collecting means in said lounger so that a person supported on the support means receives even exposure to the sun's rays.

2. The solar lounger of claim 1, said rotating means comprising an electric motor.

3. The solar lounger of claim 2 said supporting means being a chaise type chair having back and lower portions, said portions being pivotally mounted for movement to an upright collapsed position for storage.

4. The solar lounger of claim 3, said solar collecting and converting means comprising a photovoltaic solar cell.

5. The solar lounger of claim 4, said photovoltaic solar cell being mounted on said lower portion of said chair.

6. The solar lounger of claim 4, further comprising means for adjusting the angulation of the back portion of said chair, said means comprising a torsion spring causing said back portion to pivot towards an upright position and a hydraulic piston assembly to control said pivotal movement.

7. The solar lounger of claim 4 wherein said rotating means further comprises means for limiting the maximum speed of rotation to aproximately one revolution per 15 minutes.

* * * * *